US010612183B2

(12) United States Patent
Graeser et al.

(10) Patent No.: US 10,612,183 B2
(45) Date of Patent: Apr. 7, 2020

(54) MODULAR AIR DRIER

(71) Applicant: Lavatec Laundry Technology GmbH, Heilbronn (DE)

(72) Inventors: Wolf-Peter Graeser, Flein (DE); Jochen Krause, Rödental (DE)

(73) Assignee: Lavatec Laundry Technology GmbH, Heilbronn (DE)

( * ) Notice: Subject to any disclaimer, the term of this patent is extended or adjusted under 35 U.S.C. 154(b) by 8 days.

(21) Appl. No.: 15/575,943

(22) PCT Filed: May 11, 2016

(86) PCT No.: PCT/DE2016/200219

§ 371 (c)(1),
(2) Date: Nov. 21, 2017

(87) PCT Pub. No.: WO2016/184462

PCT Pub. Date: Nov. 24, 2016

(65) Prior Publication Data

US 2018/0209088 A1 Jul. 26, 2018

(30) Foreign Application Priority Data

May 21, 2015 (DE) ..... 10 2015 209 370

(51) Int. Cl.
*D06F 58/12* (2006.01)
*D06F 31/00* (2006.01)
*D06F 58/28* (2006.01)

(52) U.S. Cl.
CPC ..... *D06F 58/12* (2013.01); *D06F 31/005* (2013.01); *D06F 2058/2816* (2013.01); *D06F 2058/2864* (2013.01)

(58) Field of Classification Search
CPC ..... D06F 58/12; D06F 31/005; D06F 2058/2816; D06F 2058/2864
(Continued)

(56) References Cited

U.S. PATENT DOCUMENTS 5,528,839 A * 6/1996 Seidl ..... F26B 21/02 34/364
5,588,223 A * 12/1996 Marshall ..... D21F 5/181 34/111
(Continued)

FOREIGN PATENT DOCUMENTS

CA 2986607 A1 * 11/2016 ..... D06F 58/12
DE 102008013012 A1 9/2009
(Continued)

OTHER PUBLICATIONS

International Search Report for PCT/DE2016/200219 dated May 9, 2016.

*Primary Examiner* — Stephen M Gravini
(74) *Attorney, Agent, or Firm* — McDonnell Boehnen Hulbert & Berghoff LLP

(57) ABSTRACT

With respect to an especially efficient use of energy required for drying, a drier for drying items to be dried, comprising a receptacle for the items to be dried, an air guide for guiding air to the receptacle and a heating device for heating the air is designed and further developed in such a way that the receptacle comprises a plurality of modules (1, 2, 3, 4), arranged one behind the other, for heating, drying or cooling the items to be dried, and that at least one module (1, 2, 3, 4) is associated with a conveying device (5) for conveying the items to be dried from this module (1, 2, 3) or any module (1, 2, 3) to the next module (2, 3, 4).

11 Claims, 3 Drawing Sheets

Figure 1:
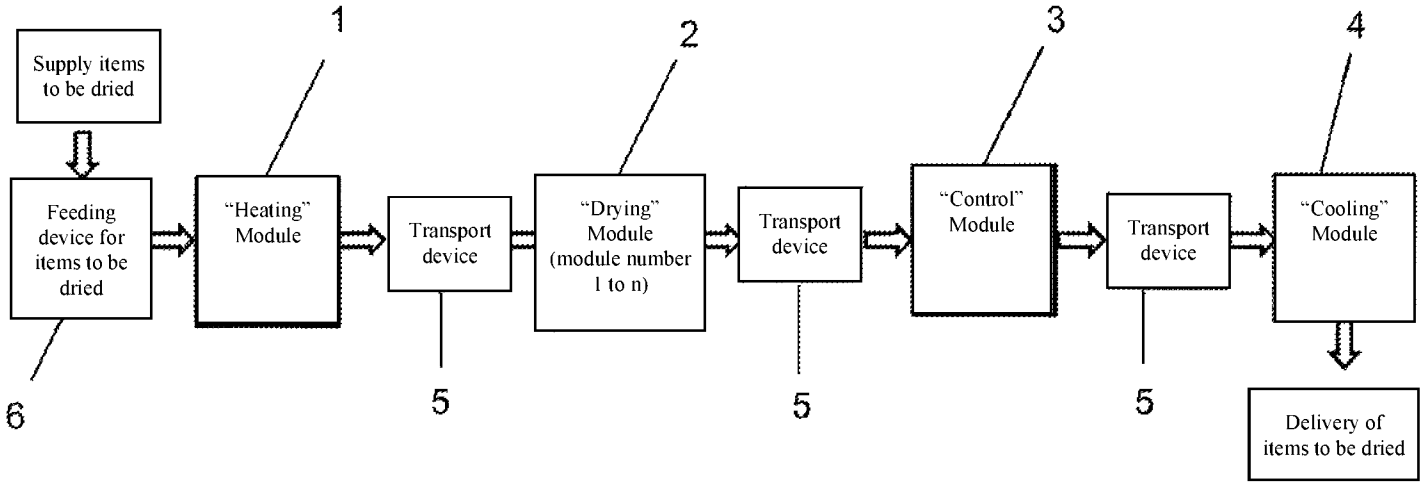

(58) Field of Classification Search
USPC ..... 34/659
See application file for complete search history.

(56) References Cited

U.S. PATENT DOCUMENTS

| | | | | | |
|---|---|---|---|---|---|
| 5,806,204 | A * | 9/1998 | Hoffman | D06F 58/12 | |
| 5,836,086 | A * | 11/1998 | Elder | F26B 3/04 | 34/396 |
| 5,881,476 | A * | 3/1999 | Strobush | F26B 13/10 | 34/210 |
| 6,029,366 | A * | 2/2000 | Poirier | F26B 25/002 | 34/166 |
| 6,101,739 | A * | 8/2000 | Rutz | B01D 53/34 | 34/373 |
| 7,024,800 | B2 * | 4/2006 | Carin | F26B 19/005 | 34/576 |
| 7,669,348 | B2 * | 3/2010 | Christy | F26B 11/16 | 110/246 |
| 7,963,048 | B2 * | 6/2011 | Pollard | F26B 15/12 | 110/315 |
| 8,567,099 | B2 * | 10/2013 | Bai | F26B 13/10 | 219/388 |
| 8,826,558 | B2 * | 9/2014 | Priebe | F26B 3/22 | 118/258 |
| 9,127,884 | B2 * | 9/2015 | Ciaschi | F26B 21/004 | |
| 9,500,408 | B2 * | 11/2016 | Spangler | F26B 15/122 | |
| 9,599,398 | B2 * | 3/2017 | Grunewald | F26B 21/001 | |
| 9,746,239 | B2 * | 8/2017 | Grabolle | F26B 23/10 | |
| 10,082,335 | B2 * | 9/2018 | Kolari | F26B 21/04 | |
| 2018/0209088 | A1 * | 7/2018 | Graeser | D06F 58/12 | |

FOREIGN PATENT DOCUMENTS

| | | | | |
|---|---|---|---|---|
| DE | 102009041063 | A1 | 12/2010 | |
| DE | 102011087874 | A1 | 6/2013 | |
| DE | 102013007028 | A1 | 10/2014 | |
| DE | 102015209370 | B3 * | 9/2016 | D06F 58/12 |
| EP | 1449953 | A1 | 8/2004 | |
| EP | 2034076 | A1 | 3/2009 | |
| JP | 07275589 | | 10/1995 | |

* cited by examiner

MODULAR AIR DRIER

This application is a U.S. National Phase Application pursuant to 35 U.S.C. § 371 of International Application No. PCT/DE2016/200219 filed May 11, 2016. The entire disclosure contents of this application is herewith incorporated by reference into the present application.

The present invention relates to a drier for drying items to be dried, comprising a receptacle for the items to be dried, an air guide for guiding air to the receptacle and a heating device for heating the air.

Driers of the above-mentioned type are well-known and are available in different embodiments. For example, such a drier is disclosed in DE 10 2011 087 874 A1. In this well-known drier a receptacle for the items to be dried is implemented, to which heated air is supplied via an air guide. A heating device is provided for heating the air.

Driers of this type are used for industrial drying processes, for example, in laundry facilities. Usually, the exhaust air from the drier can reach up to 120° C. and more. Therefore, a large amount of energy is required for operating the drier. A large part of this energy is released in the form of thermal energy to the environment. Thus, it became common practice to use heat exchangers, by means of which heat from the exhaust air is used to heat the air supply. In this way, it is possible to save and reuse a considerable part of the energy.

However, due to constantly increasing energy costs, and from an economical viewpoint, it is still desirable to achieve further energy optimizations and cost savings when using a drier.

Therefore, the present invention is based on the objective of designing and further developing a drier of the above-mentioned type, which allows for a simple and especially efficient way of using the energy required for drying.

According to the invention, the above-mentioned objective is achieved by a drier having the characteristics of claim 1. Accordingly, the drier is designed and further developed in such a way that the receptacle comprises a plurality of modules, arranged one behind the other, for heating, drying or cooling the items to be dried and that a conveying device is associated with at least one module for transporting the items to be dried from this module or any module to the next module.

In an inventive way, it was recognized that a skillful configuration of the receptacle for the items to be dried achieves in a simple manner the above-mentioned objective. Thus, in a further inventive manner, the receptacle comprises a plurality of modules, arranged one behind the other, which are appropriately configured for heating, drying or cooling the items to be dried. At the same time, the receptacle can have two or a plurality of modules, arranged one behind the other. This offers the possibility of performing individual process steps in an especially efficient manner, wherein the supplied heat and/or air, as well as a moisture content of the items to be dried can be individually controlled or regulated for each module to achieve, on the one hand, the desired drying effect and, on the other hand, the most efficient and economic use of energy. For example, an especially efficient construction comprises one module for heating, one or a plurality of modules for drying, one module for controlling the moisture content of the items to be dried and one module for cooling the items to be dried. Furthermore, the inventive drier comprises at least a conveying device associated with one module for transporting the items to be dried from this module or any module to the next module. Such a conveying device allows for a secure transport or safe transfer of the items to be dried in the drying process produced by these modules.

As a result, the inventive drier provides a drier, which allows in a simple manner for an especially efficient use of the energy required for the drying process.

Basically, the individual modules can be operated in different ways. For example, a module can work as complete as possible in air circulation mode. In the process, the required heat can be transferred to the items to be dried via heat exchangers and heat losses can be reduced via exhaust air. Other modules are designed in such a way that an air supply is blown into a reception area of the items to be dried in the module and exhaust air is discharged from the reception area. Usually, such exhaust air of a module contains a thermal content, which can be used elsewhere in the drying process. Therefore, in an advantageous embodiment, exhaust air of one module or a plurality of modules can provide at least partially an air supply for a module or a multitude of modules arranged in front, preferably directly before this module. By using at least a portion of the exhaust air as an air supply for a module or a plurality of modules arranged before the initial module, the heat contained in the exhaust air can be used for the module or a plurality of modules arranged before the initial module. This involves a direct supply of the exhaust air of a module to the reception area for the items to be dried of a different module or a plurality of modules. Alternatively, or in addition to such use of exhaust air as an air supply, the exhaust air can also be used as combustion air of the heating device, provided the heating device is operated by means of a combustion process. Besides such an operating mode of the heating device, the air can also be heated by means of steam or electrical energy, without using a combustion process. In this case, the exhaust air of a module is not used for the heating device.

Alternatively, or in addition to using one module or a plurality of modules in the manner described above, in a further advantageous manner, heat from the exhaust air of one module or a plurality of modules can be transferred at least partially to an air supply and/or air circulation mode of a module or a plurality of modules arranged in front, preferably directly before the initial module. Such a transfer operation can be performed by means of one or a plurality of heat exchangers, preferably air-to-air heat exchangers. Due to the utilization of a transfer medium—the heat exchanger—this type of deriving exhaust heat from exhaust air differs from a direct transfer of heat, as is the case, for example, when exhaust air of a module provides at least partially an air supply for a different module or a plurality of different modules. For example, a heat exchanger can be integrated in a module or directly associated with a module to allow, for example, for an air circulation mode of the module. Alternatively, or in addition, it is also possible to provide a heat exchanger or a plurality of heat exchangers, which are arranged in an air guide or integrated in an air guide, in order to preheat, if necessary, an air supply for a module by means of the exhaust air of a module.

To ensure especially high-quality drying results and an efficient use of the required energy, it is possible to arrange a module for controlling the moisture content of the items to be dried before the initial module, so as to cool the items to be dried. Such a control module can form the end of an arrangement of modules for heating and drying, in order to control the moisture content prior to cooling the items to be dried and to perform a possibly required additional drying process in the control module.

With respect to an especially efficient use of the required energy, the air supply of a module for controlling the moisture content of the items to be dried can involve at least partially air, which is heated by means of a heat exchanger, preferably an air-to-air heat exchanger, which obtains the thermal energy from the exhaust air of a module for heating the items to be dried and/or from the exhaust air of a different module or from the module for controlling the moisture content of the items to be dried. In this case, an efficient energy use can be achieved by supplying a preheated air supply. In an especially preferred manner, the air supply for this control module is provided only by air preheated in the way described above.

A module for cooling the items to be dried usually provided at the end of the arrangement of different modules can extract in an advantageous manner an air supply from the room in which this module (these modules) are installed, or from ambient air. For example, such ambient air could be supplied to the cooling module from outside a building. The cooling effect is provided by the air in the installation room or by ambient air, which is usually cooler than the air in the modules.

With respect to an efficient use of the heat energy available in the exhaust air, an exhaust air duct can comprise one or a plurality of dividing and/or switching elements, preferably dividing and/or switching flaps. By means of such dividing and/or switching elements, it is possible that exhaust air is precisely and flexibly guided to the modules, in which the supply of air is required or energy-efficient. Such dividing and/or switching elements can be centrally controlled by means of an appropriate control system. Insofar, the individual control of the dividing and/or switching elements can be performed individually and time-dependently in consideration of the drier as a whole and the overall arrangement of the modules.

If the arrangement includes a heating device, which is operated by means of a combustion process, a combustion air duct can comprise a pressure equalization valve, by means of which the air pressure or air pressure conditions in the combustion air duct can be affected or controlled. For example, if a cooling module has too much exhaust air for a desired combustion process, available or supplied excessive exhaust air can escape through the pressure equalization valve. For example, this excessive exhaust air can be guided into an air supply duct of a heat exchanger for preheating an air supply for one of the modules. If no exhaust air from a module is available, air for the heating device or heating burner can be drawn via the pressure equalization duct.

In an especially advantageous embodiment, a conveying device can be respectively arranged between two modules. Preferably, the conveying device comprises a conveyor belt or a slide or slide chute. In the case of a slide or slide cute, it is expedient to provide an appropriate height offset between the modules, so that the items to be dried are transported by the force of gravity from one module to the next module. If necessary, it is possible to provide an air pressure assistance, which ensures a safe transport of the items to be dried. As an alternative to the above-mentioned embodiments, the conveying device can be designed in the form of internal mechanics of a module or integrated in a module. By means of appropriate gripping and/or guide elements, such a conveying device or mechanics can move the transported material between the modules. When selecting an appropriate conveying device, the required number of items to be dried and transported can be taken into consideration.

With respect to a secure supply of items to be dried to the receptacle, it is possible to arrange a supply device for the items to be dried before the receptacle, which supply device for the items to be dried preferably comprises a weighing device for the items to be dried. This ensures that the drier, in particular the receptacle, is loaded with an appropriate number of items to be dried. This prevents the drier from being overloaded.

Depending on the task, heating, drying, controlling or cooling, each module can be designed in a specific way. Advantageous components of the modules can comprise an infrared temperature measuring device and/or a device for detecting a different measuring parameter for determining the moisture content of the items to be dried. A receiving portion of a module can be formed by an appropriately pivoted drum, which is powered by a motor. Furthermore, a module can have a fan, which blows air through the items to be dried. The heating device for heating the air can have a heater associated with a module. At the same time, each module can be associated with such a heater. In a particularly advantageous manner, at least one module, preferably a plurality of modules or all modules can be configured in the form of a cycle drier. Such cycle driers are well-known and provide a reliable drying unit, which can be used as an individual module in the context of the present invention.

With respect to a particularly energy-efficient operation of the drier, the drier can comprise a control or regulating device. Such a control or regulating device can control or regulate as a central element the flow and/or amount of the air supply and/or exhaust air to or from the modules and/or the heating of the air supply to the modules and/or of air located in one or a plurality of modules, depending on a predeterminable moisture content of the items to be dried. Such a control or regulating system can comprise the circuit, opening and closing of dividing and/or switching elements and/or a pressure equalization valve.

In the inventive drier, a cascaded drier is practically provided by the arrangement of a plurality of modules. At the same time, the drying air in a first module can be heated to approximately 180° C. For example, at the outlet of the drier, a temperature of 120° C. can be achieved.

According to different operating programs, the air can be supplied, depending on the moisture and/or type of items to be dried.

For example, the time in which the items to be dried prevail in the respective modules can amount to app. 4 minutes, resulting in an app. 4-minute cycle. In three modules, the drying time can amount to a total of app. 12 minutes. Subsequently, an additional cooling time of appropriate duration can be provided, for example 2 minutes. However, these periods are only to be considered as examples and can be extended or reduced in an appropriate manner, depending on the individual situation.

There are different possibilities to design and further develop the teaching of the present invention. On the one hand, this is shown by the subordinate claims and, on the other hand, by the subsequent description of preferred embodiments of the invention depicted in the drawing. In the context of describing the preferred embodiments of the invention by means of the drawing, also generally preferred embodiments and further developments of the teaching are described. In the drawing, it is shown FIG. 1 a schematic view of an embodiment of an inventive drier, FIG. 2 a schematic and detailed view of the embodiment shown in FIG. 1, which has a heating device comprising a plurality of heating burners, and FIG. 3 a schematic and detailed view of the embodiment shown in FIG. 1 in a variation with a heating device having a heater, which heats electrically or with steam.

FIG. 1 shows a schematic view of a construction of an embodiment of an inventive drier for drying items to be dried. The drier has a receptacle for the items to be dried, an air guide for guiding air to the receptacle (not shown) and a heating device for heating the air (not shown). With respect to an especially efficient use of energy required for drying, the receptacle has a plurality of modules 1, 2, 3 and 4, arranged one behind the other, for heating, drying, controlling the moisture content and cooling the items to be dried. A conveying device 5 for transporting the items to be dried between the modules 1, 2, 3 and 4 is respectively arranged between the modules 1 and 2, 2 and 3, and 3 and 4.

A supply device 6 for the items to be dried is arranged before the module 1, by means of which supply device the module 1 is loaded with the items to be dried. The items to be dried are loaded into the drier via the supply device 6 for the items to be dried. After module 4, the items to be dried are removed. FIG. 1 shows the supply of items to be dried in this cascaded drier according to the first embodiment comprising a plurality of modules 1 to 4.

Figure 2:
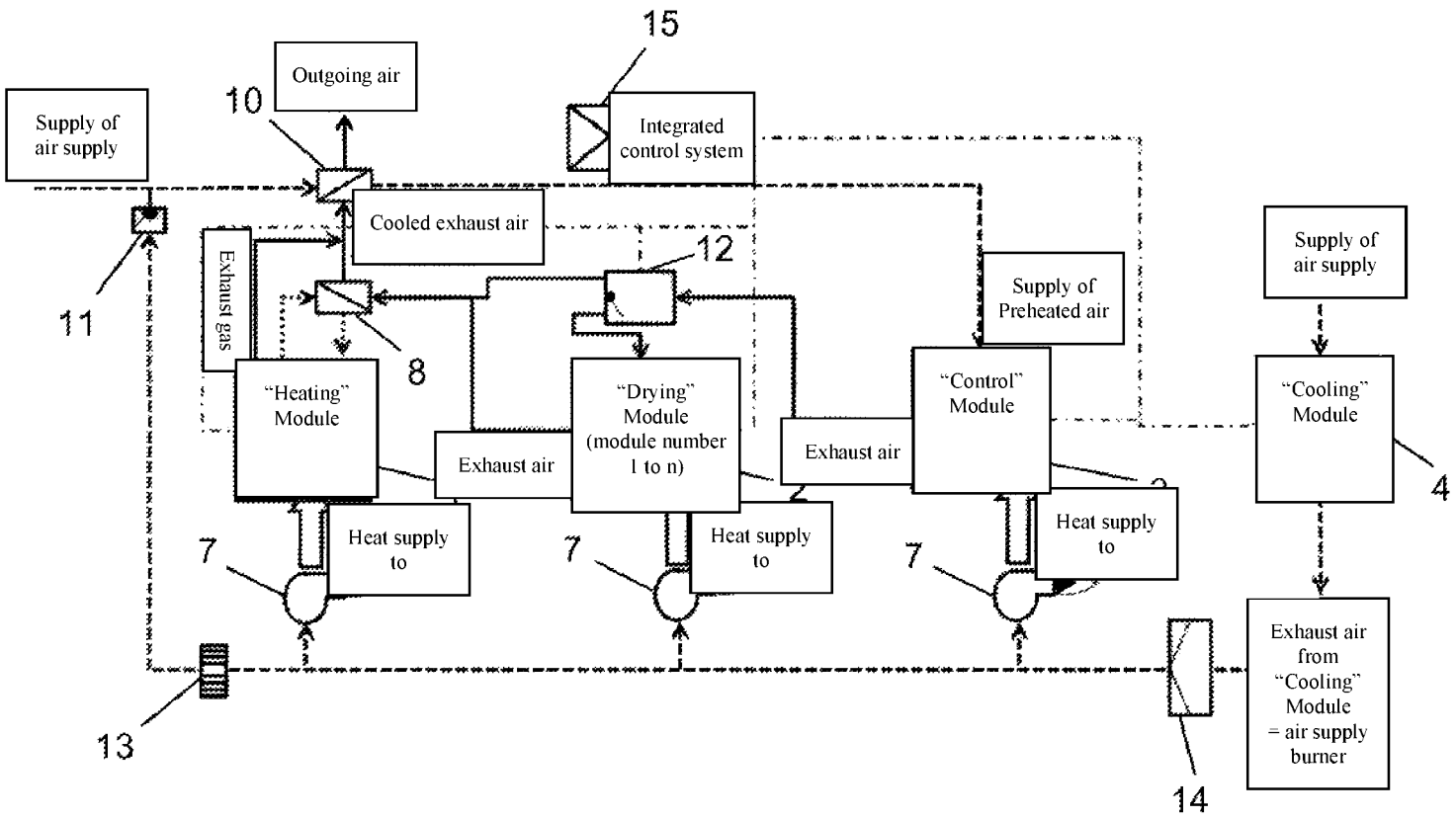
Figure 3:
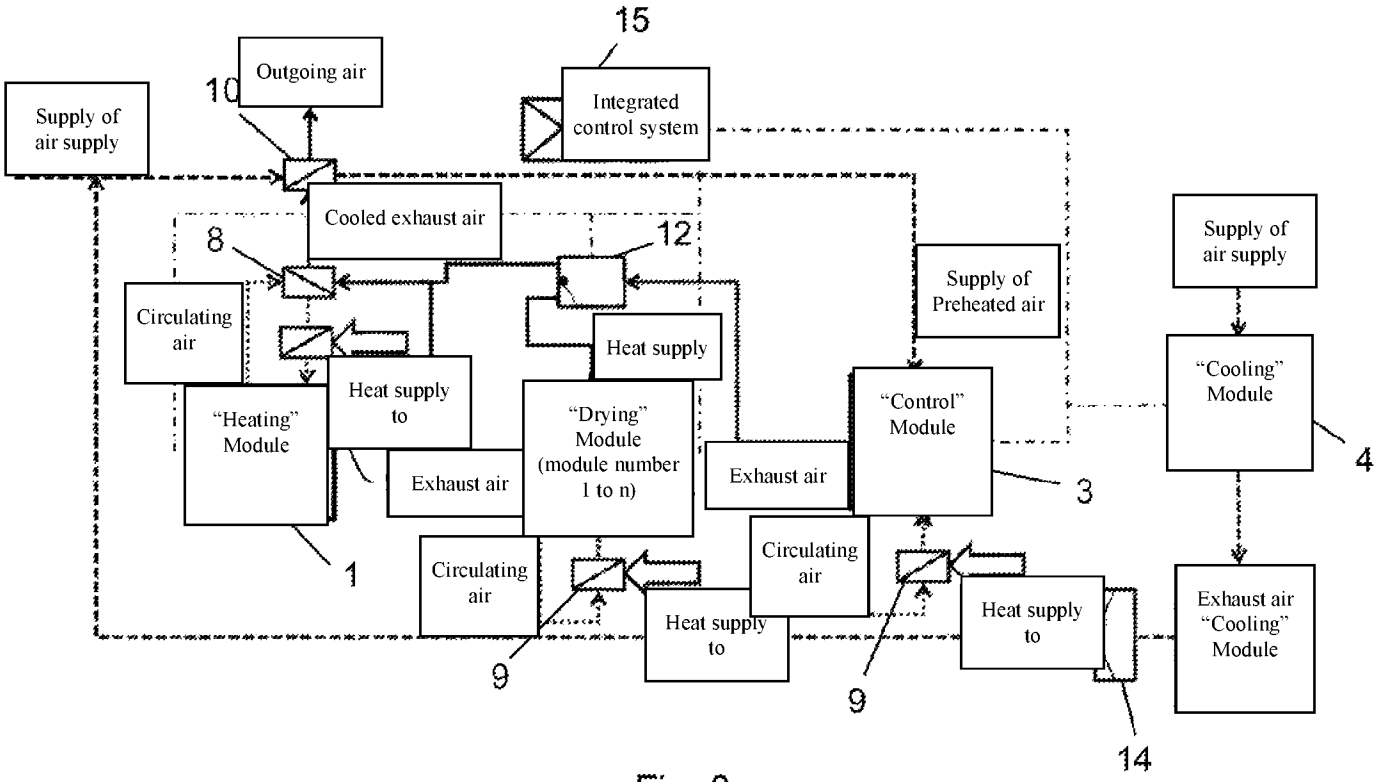

FIGS. 2 and 3 show schematic and detailed representations of the basic embodiment depicted in FIG. 1, wherein FIG. 2 shows a heating device with a plurality of heaters 7 based on a combustion process, and FIG. 3 shows a heating device with a plurality of heaters heated with steam or electrically. The difference in the configuration of the heating device results in differences of the embodiments of the air supply flow and/or exhaust air flow to or from the modules 1 to 4.

For reasons of clarity, FIGS. 2 and 3 do not show the supply device 6 for the items to be dried depicted in FIG. 1. The following description basically refers to both embodiments shown in FIGS. 2 and 3, wherein constructive differences due to differently configured heating devices shall be explained.

The module 1 for heating is basically formed by a well-known cycle drier with infrared temperature measurement or the detection of a different measuring parameter for determining the moisture content of the items to be dried. The items to be dried are located in a pivoted and motor-powered drum in the module 1. This drum forms the receiving portion for the items to be dried. The module 1 comprises a fan, which guides air in the receiving area through the items to be dried. To heat the air, the module 1 has a heating device. In the embodiment shown in FIG. 2, this heating device is formed by a burner 7, which is based on a combustion process, thus supplying heat to the module 1. Furthermore, the module 1 has an air-to-air heat exchanger 8, which is coupled into a circulating air flow integrated in the module 1. The burner 7 is also integrated in the module 1. In the same way, the module 2 for drying and the module 3 for controlling the moisture content of the items to be dried have integrated burners 7.

In the embodiment shown in FIG. 3, the heating device comprises a plurality of air heaters 9 heated with steam or electrically. Insofar, the embodiment shown in FIG. 3, comprises a heating device, which has air heaters 9 instead of burners 7. The air heaters 9 are also integrated in the modules 1, 2 and 3.

In the embodiment shown in FIG. 2, an exhaust gas system is provided for discharging combustion air of the burners 7, wherein the module 1 of the burners 7, the heat exchangers 8 and the exhaust gas system are configured in such a way that it is possible to perform the drying process in the module 1 with a circulating air portion of 100%. Such an air circulation mode with a circulating air portion of 100% in the module 1 is also possible in the embodiment shown in FIG. 3.

The module 2 for drying also basically corresponds to a cycle drier with an infrared temperature measurement or a detection of a different measuring parameter for determining the moisture content of the items to be dried. The items to be dried are dried with an energy supply and a variable air supply portion in one or a plurality of these modules; it is possible to integrate more than one module 2 for drying in the drier. At the same time, the air supply of the module 2 is the exhaust air of the respectively subsequent module, in the present case the module 3 for controlling the moisture content of the items to be dried.

The module 3 for controlling the moisture content of the items to be dried also basically corresponds to a cycle drier with an infrared temperature measurement or a detection of a different measuring parameter for determining the moisture content of the items to be dried. The already dried items are dried again in module 3, if different parameters, such as fabric temperature, heating or cooling speed and/or direct exhaust moisture measurement indicate too much residual moisture in the items to be dried. The air supply of the module 3 is a preheated air supply from a heat exchanger 10. This heat exchanger 10 obtains thermal energy from the exhaust air of modules 1, 2 and possibly 3. Furthermore, the heat exchanger 10 can obtain heat from the exhaust air of the module 4, because the exhaust air from this module 4 can be, or is coupled into a fresh air supply.

The module 4 for cooling also basically involves a cycle drier. However, in contrast to the remaining modules 1, 2 and 3, it has no heating device and no circulation air flaps. The supplied air of the module 4 is extracted from the installation room or outside air, from outside a building shell. According to FIG. 2, the exhaust air of the module 4 serves the burners 7 of the other modules 1, 2 and 3 as combustion air. If none or only a little air is required, the exhaust air escapes from the module 4 or from the cooling process via a pressure equalization valve 11 into the air supply duct before the heat exchanger 10. If no exhaust air from the module 4 is available, air for the burners 7 is drawn via the pressure equalization valve 11. In comparison to the fans in the other modules 1, 2 and 3, the performance of a fan of the module 4 is reduced.

The exhaust air of the module 3 is guided to a dividing/switching flap 12, which supplies the exhaust air directly to the module 2 or the heat exchanger 8 of the module 1. It is also possible, to guide the exhaust air by means of the dividing/switching flap 12 partially to the module 2 and partially to the heat exchanger 8. The dividing/switching flap 12 is controlled in a continuously regulated manner, which results in appropriately opening or closing the dividing/switching flap 12 and distributing the exhaust air of the module 3, to avoid over-drying or heat-damaging the items to be dried.

Furthermore, the embodiment shown in FIG. 2 comprises in the exhaust air duct leading out of the module 4 a thermally active compound as an optional regenerator 13. In both embodiments of FIGS. 2 and 3, an air filter 14 and/or lint filter is also arranged in the exhaust air duct leading of the module 4.

In the inventive drier, the items to be dried and a dry air flow essentially go through the process steps in counter-current. The transported material is reloaded from one module 1, 2 or 3 to a different module 2, 3 or 4 after an expiration of adjustable time units or cycles. The modules 1, 2, 3 and 4 are loaded on the front side, unloaded on the rear side.

In module 1, the items to be dried are heated in a circulation process to maintain high moisture and high heat transfer performances. For this purpose, the module 1 has an integrated air-to-air heat exchanger 8, to which on the side of the exhaust air heat from the subsequent modules 2 and 3 is applied. On the other side, the supplied heat is released to the air circulation of the module 1.

If the transferred heat is not sufficient for reaching the desired temperature of the items to be dried, additional energy is supplied by means of a burner 7 or air heater 9. When using a burner 7, a required portion of air—combustion gas—is discharged.

The exhaust heat contained in the exhaust air and/or the gases from the module 1 and cooled exhaust air of the modules 2 and 3 are cooled again after the initial heat exchanger 8 in a downstream heat exchanger 10. The heat thus transferred is supplied to the air supply of the module 3.

The heated items to be dried are reloaded into the module 2 by means of an internal or external conveying device 5. The exhaust air of the subsequent module, a further module 2 or module 3, is supplied to this module 2. Due to the largely completed drying process, this hot exhaust air contains only little moisture and can be loaded with moisture in module 2. In addition, thermal energy is supplied.

If in module 2 one of the parameters, the temperature of the items to be dried, the exhaust air temperature and the air supply temperature, is exceeded, or the temperature difference exceeds within a predeterminable time unit—temperature increase speed—a predetermined limit value, the heat supply of the burner 7 or the air heater 9 and the incoming air supply are partially or completely interrupted by means of the dividing/switching flap 12.

The exhaust air from one or a plurality of modules 2 is supplied to the preceding module 1 or to the air-to-air heat exchanger 8 of the module 1. A portion of the exhaust heat remaining in the exhaust air after the heat exchanger 8 is supplied by means of a second air-to-air heat exchanger 10 to the air supply of the module 3. The cooled exhaust air is discharged as outgoing air, for example, via the roof.

When using air heaters 9, which can be operated in all embodiments not only electrically, but also with steam, it is possible to eliminate the use of exhaust heat from the module 4 in the burners 7, and the components pressure equalization valve 11 and optional regenerator 13, for example, in the form of a thermally active mass. Then, the exhaust air from the module 4 is supplied to the air supply before the second heat exchanger 10 and, if not needed, it is discharged via the air supply duct, as shown in FIG. 3.

The mainly independently regulated modules 1 to 4 are coordinated by means of a control and regulating device 15 used as integrated control system. This integrated control system controls the loading and unloading processes of the modules 1 to 4, the control of bypass flaps, for example, 11 and 12, and coordinates the energy consumption.

For example, the process of unloading the modules 1 to 4 can be performed by tipping the entire system with stationary modules 1 to 4 without fan support. Furthermore, it is possible to perform a single tipping discharge without fan support. Moreover, the stationary modules 1 to 4 can also be unloaded with fan support.

FIG. 3 includes a graphic simplification: analogous to the current commercial cycle driers air circulation and air supply is regulated via flaps on the intake side of the fan. Representing the air supply separate from the circulating air in the modules 2 and 3 serves to improve clarity.

In a further advantageous embodiment, it is possible to implement a plurality of variations for supplying heat in a drier. This means that it is possible to implement burners 7, electrical or steam-powered air heaters 9 in a single drier. Depending on the requirements and task of the individual modules 1 to 3, the one or other type of heater or heating device can be used in an especially advantageous manner.

With respect to further advantageous embodiments of the inventive drier, reference is made to the general part of the description and the enclosed claims to avoid repetitions. It should be emphasized that the embodiments described above only have the purpose of discussing the claimed teaching, but not to restrict those teaching to the embodiments.

LIST OF REFERENCE NUMERALS

1 Module for heating
2 Module for drying
3 Module for controlling the moisture content
4 Module for cooling
5 Conveying device
6 Supply device for the items to be dried
7 Burner
8 Heat exchanger
9 Air heater
10 Heat exchanger
11 Pressure equalization valve
12 Dividing/switching flap
13 Regenerator
14 Air filter
15 Control or regulating device

The invention claimed is:

1. A drier for drying laundry items to be dried, comprising a receptacle for the laundry items to be dried, an air guide for guiding air to the receptacle, and a heating device for heating the air, characterized in that the receptacle comprises a plurality of modules, arranged in succession, for heating, drying, controlling a moisture content, or cooling the items to be dried, and that at least one module of the plurality of modules is associated with a conveying device for conveying the items to be dried from the at least one module to a next module in the succession, characterized in that a module for controlling the moisture content of the items to be dried is arranged before a module for cooling the items to be dried.

2. A drier according to claim 1, characterized in that exhaust air from a module or a plurality of modules provides at least partially an air supply for a module arranged in front, or a multitude of modules arranged in front, and/or can be used as combustion air of the heating device.

3. A drier according to claim 1, characterized in that heat from the exhaust air of one module or a plurality of modules can be transferred at least partially to the air supply and/or air circulation mode of a module, or a plurality of modules arranged in front, by means of one or a plurality of heat exchangers (8).

4. A drier according to claim 1, characterized in that an air supply of a module for controlling the moisture content of the items to be dried comprises at least partially air, which is heated by means of a heat exchanger, which obtains thermal energy from the exhaust air of a module for heating the items to be dried and/or from the exhaust air of a different module or module for controlling the moisture content of the items to be dried.

5. A drier according to claim 1, characterized in that an air supply of a module for cooling the items to be dried can be extracted from an installation room or from ambient air.

6. A drier according to claim 1, characterized in that an exhaust air duct can comprise one or a plurality of dividing and/or switching elements.

7. A drier according to claim 1, characterized in that a combustion air duct comprises a pressure equalization valve.

8. A drier according to claim 1, characterized in that a conveying device is arranged between two modules, respectively, wherein the conveying device comprises a conveyor belt or a slide or slide chute, or that the conveying device designed in the form of internal mechanics of a module or integrated in a module.

9. A drier according to claim 1, characterized in that a supply device for the items to be dried is arranged before the receptacle, wherein the supply device for the items to be dried comprises a weighing device for the items to be dried.

10. A drier according to claim 1, characterized in that at least one module is configured in the form of a cycle drier.

11. A drier according to claim 1, characterized in that the drier comprises a control and regulating device, which controls or regulates a flow and/or amount of the air supply and/or exhaust air to or from the modules and/or the heating of the air supply to the modules and/or of air located in one or a plurality of modules, depending on a predeterminable moisture content of the items to be dried.

* * * * *